US011114265B2

(12) United States Patent
Van Kampen et al.

(10) Patent No.: US 11,114,265 B2
(45) Date of Patent: Sep. 7, 2021

(54) THERMAL MANAGEMENT IN HIGH POWER RF MEMS SWITCHES

(71) Applicant: CAVENDISH KINETICS, INC., San Jose, CA (US)

(72) Inventors: Robertus Petrus Van Kampen, S-Hertogenbosch (NL); Richard L. Knipe, McKinney, TX (US)

(73) Assignee: Cavendish Kinetics, Inc., San Jose, CA (US)

( * ) Notice: Subject to any disclaimer, the term of this patent is extended or adjusted under 35 U.S.C. 154(b) by 47 days.

(21) Appl. No.: 15/770,698

(22) PCT Filed: Nov. 14, 2016

(86) PCT No.: PCT/US2016/061931
§ 371 (c)(1),
(2) Date: Apr. 24, 2018

(87) PCT Pub. No.: WO2017/087336
PCT Pub. Date: May 26, 2017

(65) Prior Publication Data

US 2019/0066957 A1 Feb. 28, 2019

Related U.S. Application Data

(60) Provisional application No. 62/256,005, filed on Nov. 16, 2015.

(51) Int. Cl.
*H01H 59/00* (2006.01)
*H01H 1/00* (2006.01)

(52) U.S. Cl.
CPC . *H01H 59/0009* (2013.01); *H01H 2001/0084* (2013.01); *H01H 2059/0027* (2013.01);
(Continued)

(58) Field of Classification Search
CPC ... H01H 2001/0084; H01H 2059/0072; H01H 2059/0027; H01H 2239/072; H01H 59/0009
(Continued)

(56) References Cited

U.S. PATENT DOCUMENTS 5,638,946 A * 6/1997 Zavracky ..... G11C 23/00 200/181
6,307,451 B1 10/2001 Saitoh et al.
(Continued)

FOREIGN PATENT DOCUMENTS

CN 102256893 A 11/2011
CN 104756252 A 7/2015
(Continued)

OTHER PUBLICATIONS

International Search Report and Written Opinion dated Feb. 24, 2017, in corresponding application No. PCT/US2016/061931.
(Continued)

*Primary Examiner* — Bernard Rojas
(74) *Attorney, Agent, or Firm* — Withrow & Terranova, PLLC

(57) ABSTRACT

The present disclosure generally relates to a mechanism for making a MEMS switch that can switch large electrical powers. Extra landing electrodes are employed that provide added electrical contact along the MEMS device so that when in contact current and heat are removed from the MEMS structure close to the hottest points.

28 Claims, 5 Drawing Sheets

(52) U.S. Cl.
CPC ..... *H01H 2059/0072* (2013.01); *H01H 2239/072* (2013.01)

(58) Field of Classification Search
USPC ..... 335/78; 200/181
See application file for complete search history.

(56) References Cited

U.S. PATENT DOCUMENTS

| | | | | |
|---|---|---|---|---|
| 6,307,452 | B1 | 10/2001 | Sun | |
| 7,609,136 | B2 * | 10/2009 | Wang | H01H 59/0009 200/181 |
| 2002/0005341 | A1 | 1/2002 | Seki | |
| 2003/0146079 | A1 * | 8/2003 | Goldsmith | H01P 1/127 200/181 |
| 2003/0227361 | A1 | 12/2003 | Dickens et al. | |
| 2004/0124073 | A1 * | 7/2004 | Pillans | B81B 3/0008 200/181 |
| 2008/0060920 | A1 * | 3/2008 | Aksyuk | H01H 59/0009 200/181 |
| 2009/0159410 | A1 * | 6/2009 | Wang | H01H 59/0009 200/181 |
| 2012/0125747 | A1 * | 5/2012 | Chu | H01G 5/18 200/181 |
| 2016/0055980 | A1 * | 2/2016 | Knipe | B81B 3/0051 361/278 |
| 2016/0172112 | A1 * | 6/2016 | Knipe | H01G 5/38 307/109 |

FOREIGN PATENT DOCUMENTS

| | | | |
|---|---|---|---|
| WO | 2014165624 | A1 | 10/2014 |
| WO | 2015017743 | A1 | 2/2015 |
| WO | 2015050761 | A1 | 4/2015 |

OTHER PUBLICATIONS

Notification of Reasons for Refusal for Japanese Patent Application No. 2018-525367, dated Oct. 13, 2020, 6 pages.
Search Report issued in corresponding Chinese Patent Application No. 2016800664423, dated Jan. 15, 2019 (5 pages).
International Preliminary Report on Patentability issued in International Application No. PCT/US2016/061931, dated May 22, 2018 (8 pages).
Office Action issued in corresponding Chinese Patent Applicationn No. 2016800664423, dated Jan. 24, 2019 (32 pages).
Office Action issued in corresponding Chinese Patent Application No. 2016800664423, dated Sep. 4, 2019 (14 pages).
Third Office Action for Chinese Patent Application No. 201680066442.3, dated Feb. 21, 2020, 14 pages.
Examination Report for European Patent Application No. 16801685.5, dated Feb. 24, 2021, 4 pages.
Decision to Grant for Japanese Patent Application No. 2018-525367, dated Mar. 9, 2021, 5 pages.

* cited by examiner

THERMAL MANAGEMENT IN HIGH POWER RF MEMS SWITCHES

BACKGROUND OF THE DISCLOSURE

This application is a 35 U.S.C 371 national phase filing of International Patent Application No. PCT/US2016/061931, filed Nov. 14, 2016, which claims priority to U.S. Provisional Patent Application No. 62/256,005 filed Nov. 16, 2015, the disclosures of which are incorporated herein by reference in their entireties.

Field of the Disclosure

Embodiments of the present disclosure generally relate to a technique for limiting temperature rise in MEMS switches in high electrical power applications.

Description of the Related Art

In operating a MEMS resistive switch, where a plate moves between a first position and a second position making electrical contact with a landing electrode, high electrical powers applied across the switch can cause current flows through the free standing MEMS device. These currents can cause resistive heating resulting in a temperature rise in the MEMS portion that can limit the device lifetime or modify the device operation in unwanted ways. The heating could cause unwanted thermal expansion leading to changes in the switching voltages or to phase changes in the alloy materials often used in the device fabrication.

The plate of the MEMS device moves by applying a voltage to an actuation electrode. Once the electrode voltage reaches a certain voltage oftentimes referred to as a snap-in voltage, the plate moves towards the electrode. The plate moves back to the original position once the voltage is lowered to a release voltage. The release voltage is typically lower than the snap-in voltage due to the higher electrostatic forces when the plate is close to the actuation electrode and due to stiction between the plate and the surface to which the plate is in contact once moved closer to the electrode. The spring constant of the MEMS device sets the value of the pull in voltage and pull off voltage. If the nature of the MEMS material changes due to heating, then these voltages are also altered which is unwanted in a product.

Therefore, there is a need in the art for a MEMS switch that can switch large voltages or currents without leading to excessive temperature rise in the MEMS. This is particularly important for switching RF signals in mobile phone applications.

SUMMARY OF THE INVENTION

The present disclosure generally relates to a mechanism for controlling temperature rise in a MEMS switch caused by current flows induced in the MEMS plate when switching high power electrical signals such as can be found in RF tuners in mobile phone applications. Electrical landing posts can be positioned to provide a parallel electrical path while also providing a thermal path to reduce heat in the plate.

In one embodiment, a MEMS device comprises a substrate having a plurality of electrodes formed therein, wherein the plurality of electrodes comprises at least an anchor electrode, a pull-in electrode and an RF electrode; a first insulating layer disposed over the plurality of electrodes and the substrate; a switching element disposed over the insulating layer, wherein the switching element includes an anchor portion, a leg portion and a bridge portion and wherein the anchor portion is electrically coupled to the anchor electrode; a first post coupled to the RF electrode; and a second post electrically coupled to the anchor electrode, wherein the switching element is movable between a first position spaced from the first post and the second post, and a second position in contact with the first post and the second post.

In another embodiment, a MEMS device comprises a substrate having a plurality of electrodes formed therein, wherein the plurality of electrodes comprises at least an anchor electrode, a pull-in electrode and an RF electrode; a first insulating layer disposed over the plurality of electrodes and the substrate; a switching element disposed over the insulating layer, wherein the switching element includes an anchor portion, a leg portion and a bridge portion and wherein the anchor portion is electrically coupled to the anchor electrode, wherein the switching element has a bottom surface that has an insulating portion and a conductive portion; a first post coupled to the RF electrode; and a second post disposed over the anchor electrode and electrically coupled to the anchor electrode, wherein the switching element is movable between a first position spaced from the first post and the second post, and a second position in contact with the first post and the second post and wherein the insulating portion contacts the second post in the second position and the conductive portion contacts the first post in the second position.

In another embodiment, a method of forming a MEMS device comprises depositing an insulating layer over a substrate, the substrate having a plurality of electrodes formed therein, wherein the plurality of electrodes includes at least an anchor electrode, a pull-in electrode and an RF electrode; removing at least a portion of the insulating layer to expose at least a portion of the anchor electrode and at least a portion of the RF electrode; forming a first post over and in contact with the RF electrode; forming a second post over and in contact with the anchor electrode; and forming a switching element over the substrate, first post and second post, wherein the switching element includes an anchor portion that is electrically coupled to the anchor electrode, a leg portion and an RF electrode, wherein the switching element is movable from a first position spaced from the first post and the second post and a second position in contact with the first post and the second post.

In another embodiment, a method of forming a MEMS device comprises depositing an insulating layer over a substrate, the substrate having a plurality of electrodes formed therein, wherein the plurality of electrodes includes at least an anchor electrode, a pull-in electrode and an RF electrode; removing at least a portion of the insulating layer to expose at least a portion of the anchor electrode and at least a portion of the RF electrode; forming a first post over and in contact with the RF electrode; forming a second post over the anchor electrode, wherein the second post is electrically coupled to the anchor electrode and wherein the second post is disposed over and in contact with the insulating layer; and forming a switching element over the substrate, first post and second post, wherein the switching element includes an anchor portion that is electrically coupled to the anchor electrode, a leg portion and an RF electrode, wherein the switching element has a bottom surface that has an insulating portion and a conductive portion, wherein the switching element is movable from a first position spaced from the first post and the second post and a second position in contact with the first post and the second post and wherein the insulating portion contacts the second post in the second position and the conductive portion contacts the first post in the second position.

BRIEF DESCRIPTION OF THE DRAWINGS

So that the manner in which the above recited features of the present disclosure can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

To facilitate understanding, identical reference numerals have been used, where possible, to designate identical elements that are common to the figures. It is contemplated that elements disclosed in one embodiment may be beneficially utilized on other embodiments without specific recitation.

DETAILED DESCRIPTION

The present disclosure generally relates to a mechanism for controlling temperature rise in a MEMS switch caused by current flows induced in the MEMS plate when switching high power electrical signals such as can be found in RF tuners in mobile phone applications. Electrical landing posts can be positioned to provide a parallel electrical path while also providing a thermal path to reduce heat in the plate.

Figure 1:
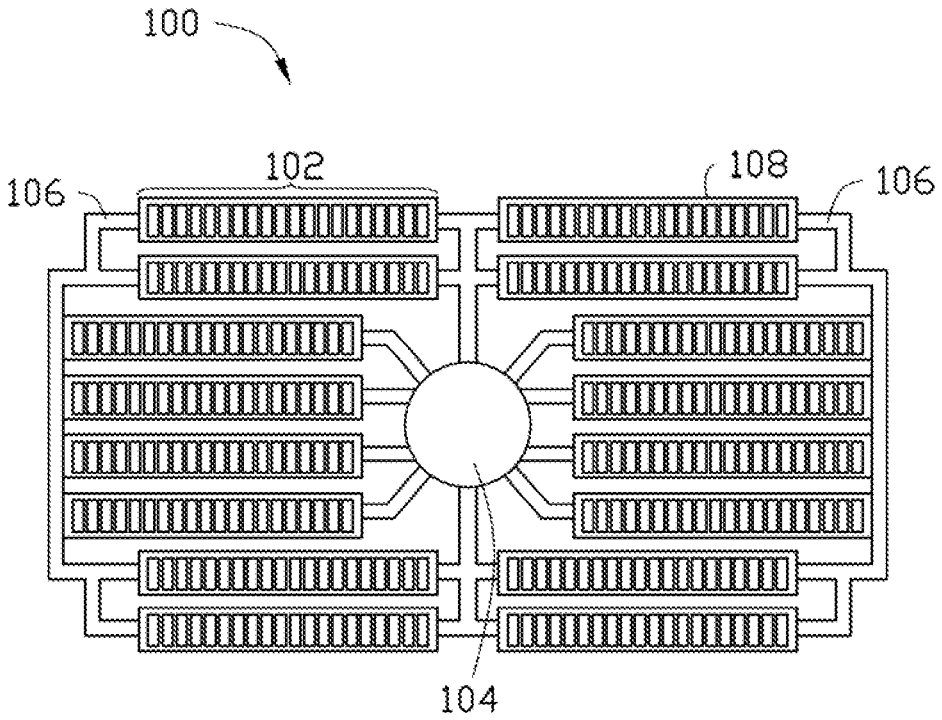
FIG. 1 is a schematic top view of a MEMS ohmic switch according to one embodiment.

FIG. 1 shows a possible implementation of a MEMS ohmic switch 100 shown from the top. The MEMS ohmic switch 100 contains an array of cells 102. The RF connections 104 and 106 to each cell are on opposite ends. Each cell 102 contains an array of (5 to 40) switches 108 working in parallel. All switches 108 in a single cell 102 are actuated at the same time and provide a minimum capacitance when turned off or a low resistance between the terminals when turned on. Multiple cells 102 can be grouped to lower the total resistance.

Figure 2A:
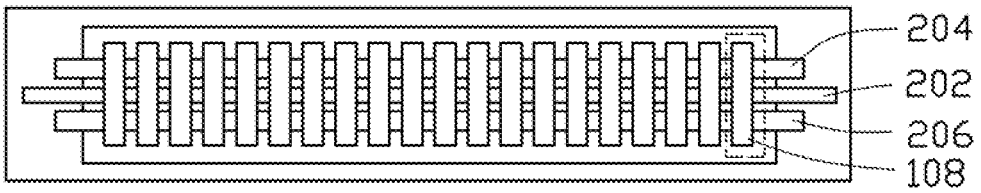
FIGS. 2A and 2B are schematic top and cross-sectional illustrations of the MEMS device of the MEMS ohmic switch of FIG. 1.

FIG. 2A shows the top view of the MEMS device of the MEMS cell 102 of FIG. 1. The cell 102 contains an array of switches 108. Underneath the switches 108 there is an RF electrode 202 and pull-in electrodes 204 and 206 to actuate the switches to the down-position (switch closed).

Figure 2B:
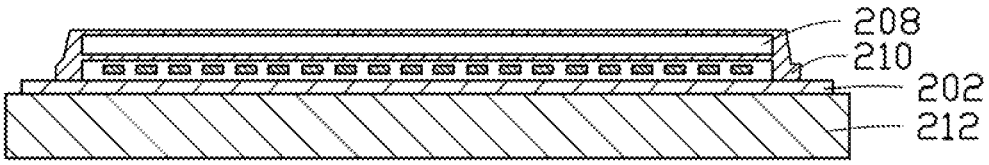

FIG. 2B shows the side view with pull up electrode 208 to actuate the switches 108 to the up-position (switch open), cavity 210 and underlying substrate 212. The substrate 212 can contain multiple metal levels for interconnect and also CMOS active circuitry to operate the device.

Figure 3A:
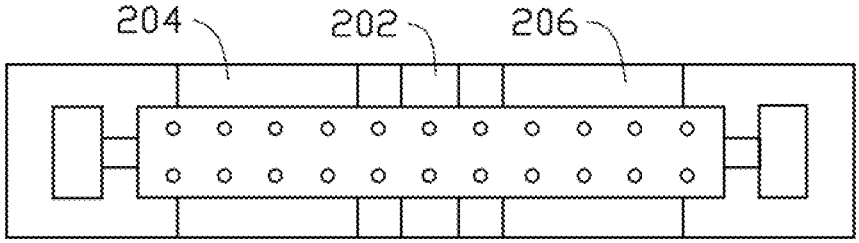
FIG. 3A is a schematic top illustration of an individual switching element in the MEMS device of the MEMS ohmic switch of FIG. 1.
Figure 3B:
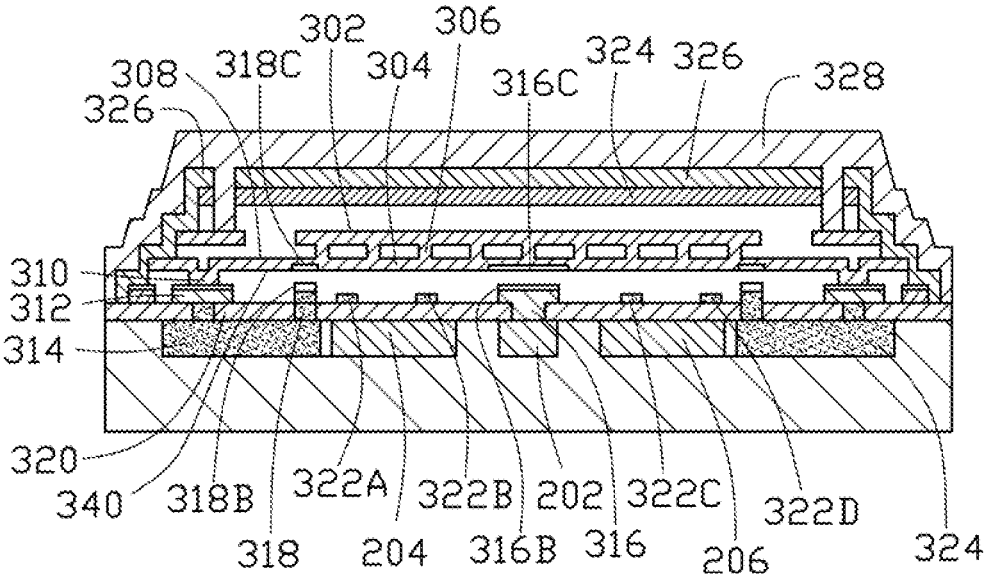
FIGS. 3B-3D are schematic cross-sectional illustrations of an individual switching element in the MEMS device of the MEMS ohmic switch of FIG. 1 according to various embodiments.

FIG. 3A shows a top view of one of the switches 108 in the array cells 102 in FIGS. 1 and 2A. FIG. 3B shows a cross-section view of the switch 108 according to one embodiment. The switch 108 comprises a first MEMS device having a first electrode, a second electrode, and a plate movable between a first position spaced a first distance from the first electrode and a second position spaced a second distance from the first electrode. Very often a MEMS switch will have a stiff moveable plate a flexible leg portion that acts like a weak spring which is contacted to an anchor portions that locates the MEMS device. The stiff MEMS portion will sit over a landing electrode which contains a conducting post and one or more pull in electrodes which usually reside between the landing electrode and the flexible leg portion. The flexible leg portions provide electrical connection to close the circuit from the landing electrode through the stiff portion of the MEMS beam to the conducting anchor holding the stiff end of the leg portion. To make the leg portion flexible the metal has to be made thinner and or narrower than the stiff portion of the MEMS device, this means these sections are the most resistive and generate the most heat when a DC or RF AC current flows through the MEMS device when it is turned on. To reduce the effects of heating of the legs, conducting landing posts close to the legs can be placed on the substrate connected through low resistance interconnect to the stiff anchor of the MEMS device. Conducting portions on the underside of the MEMS cantilever allow voltages on the MEMS device to be shunted through the conducting posts when the MEMS switch is pulled down to make contact with the central conducting electrode. This contact both reduces the current flow through the narrow leg portions of the MEMS as well as providing an additional thermal path from the MEMS cantilever to the substrate.

The switch 108 contains a stiff bridge consisting of conductive layers 302, 304 which are joined together using an array of posts 306. Layer 302 may not extend all the way to the end of the structure, making layer 302 shorter in length than layer 304. The MEMS bridge is suspended by legs 308 formed in the lower layer 304 and/or in the upper layer 302 of the MEMS bridge and anchored with via 310 onto conductor 312 which is connected to the anchor electrode 314. This allows for a stiff plate-section and compliant legs to provide a high contact-force while keeping the operating voltage to acceptable levels.

Landing post 316 is conductive and makes contact with the conducting underside of the MEMS bridge. 316B is a surface material on the landing post 316 that provides good conductivity, low reactivity to the ambient materials and high melting temperature and hardness for long lifetime. A second set of landing electrodes 318 near the leg portion of the moveable plate with conducting surface 318B made from the same material as 316B, is used to make electrical contact to anchor electrode 314. Although not shown in these figures, there may be an insulating layer over the top and underside of the conductive layers 302, 304. A hole can be made in the insulator on the underside of layer 304 in the landing post area to expose a conducting region 316C and 318C for the conducting posts to make electrical contact with when the MEMS is pulled down. As shown in FIG. 3B an opening is made in the insulating layer 320 that overlies the anchor electrode 314, pull-in electrodes 204, 206 and the RF electrode 202. Within the opening, landing electrodes 316 and 318 or posts are formed. The landing electrodes 318 provide both electrical coupling and thermal coupling of the switching element to the anchor electrode 314 when the switching element is in contact with the landing electrode 318. The landing post 316 provides both electrical and thermal coupling of the switching element to the RF electrode 202 when the switching element is in contact with the landing electrode 316. The landing electrode 318 provides a current path to the anchor electrode 314 in parallel with the legs 308 and thus reduces the current through the leg-portion of the switch and thus reduces heating of the switch. Typical materials used for the contacting layers 316, 316B, 316C, 318, 318B, 318C include Ti, TiN, TiAl, TiAlN, AlN, Al, W, Pt, Ir, Rh, Ru, $RuO_2$, ITO and Mo and combinations thereof. In the actuated down state layer 304 of the MEMS bridge may land on multiple posts 322A-322D, which are provided to avoid secondary landing the MEMS bridge which can lead to reliability issues. The bottom surface of the switching element has a thin electrically insulating layer 340 formed thereon. Portions of the insulating layer 340 are removed to expose the electrically conductive material such as at 316C, 318C so that the switching element will be electrically coupled to the first and second posts 316, 318 when the switch is in the bottom position. In FIG. 3B, there are insulating portions and conductive portions of the bottom surface of the switching element, and the conductive portions contact the first and second posts 316, 318.

Above the MEMS bridge there is a dielectric layer 324 which is capped with metal 326 which is used to pull the MEMS up to the roof for the off state. Dielectric layer 324 avoids a short-circuit between the MEMS bridge and the pull-up electrode in the actuated-up state and limits the electric fields for high reliability. Moving the device to the top helps reduce the capacitance of the switch in the off state. The cavity is sealed with dielectric layer 328 which fills the etch holes used to remove the sacrificial layers. It enters these holes and helps support the ends of the cantilevers, while also sealing the cavity so that there is a low pressure environment in the cavities.

Figure 3C:
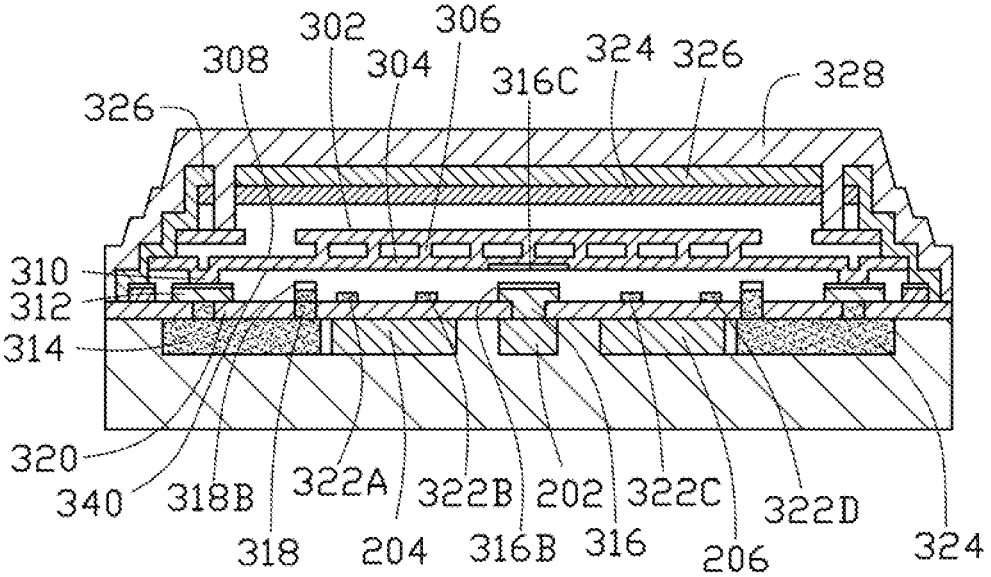

FIG. 3C shows a cross-section view of the switch 108 according to another embodiment. In the embodiment shown in FIG. 3C, the dielectric layer at the underside of the conductive layer 304 is not removed above the anchor post 318. Thus, when the switch is landed on the anchor post, the post 318 provides thermal conductivity to reduce the temperature of the switch when the switch is in contact with the post 318, but it does not carry any current. As shown in FIG. 3C, there are insulating portions and conductive portions in the bottom surface of the switching element. The conductive portion 316C will contact the first post 316 when the switching element is pulled down and the insulating portion will contact the second post 318 when the switching element is pulled down. Hence, the second post 318 only provide thermal conductivity, not electrically conductivity to the switching element whereas the first post 316 provides both thermal and electrical conductivity.

Figure 3D:
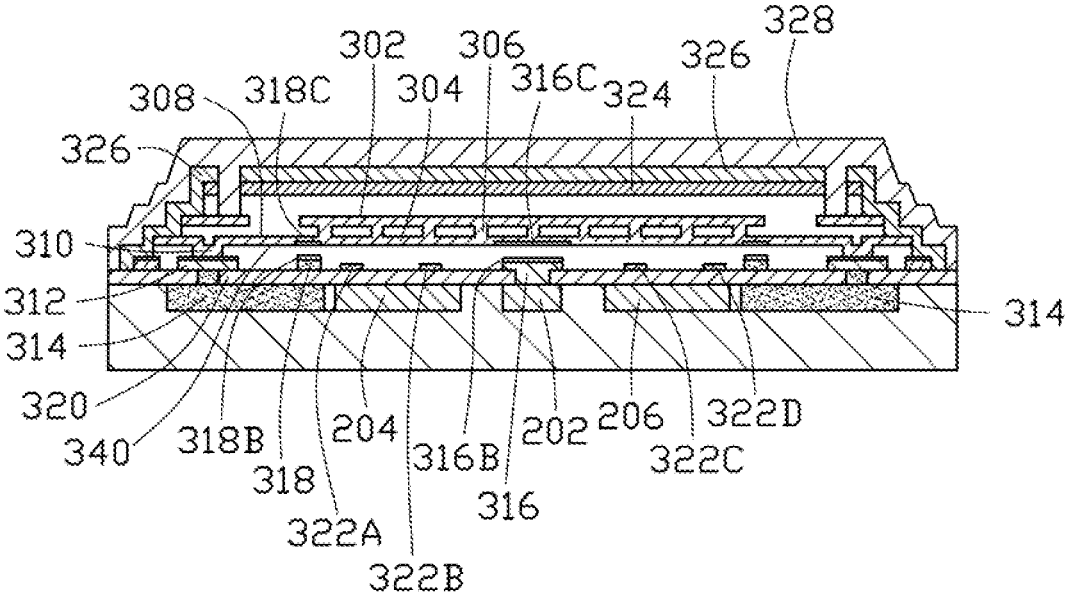

FIG. 3D shows a cross-section view of the switch 108 according to another embodiment. In the embodiment shown in FIG. 3D, the post 318 is disposed directly on the insulating layer 320 and thus not in electrical contact with the anchor electrode 314. Thus, the post 318 provides thermal conductivity to reduce the temperature of the switch when the switch is in contact with the post 318, but it does not carry any current.

Figure 4A:
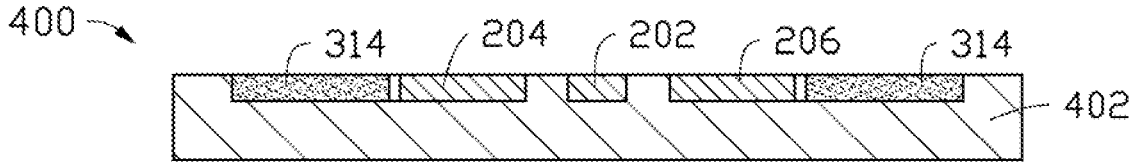
FIGS. 4A-4D are schematic illustrations of a MEMS ohmic switch at various stages of fabrication according to one embodiment.

FIGS. 4A-4D are schematic illustrations of a MEMS ohmic switch 400 at various stages of fabrication according to one embodiment. As shown in FIG. 4A, the substrate 402 has a plurality of electrodes including the anchor electrodes 314, pull-in electrodes 204, 206 and the RF electrode 202. It is to be understood that the substrate 402 may comprise a single layer substrate or a multi-layer substrate such as a CMOS substrate having one or more layers of interconnects. Additionally, suitable material that may be used for the electrodes 314, 202, 204, 206 include titanium-nitride, aluminum, tungsten, copper, titanium, and combinations thereof including multi-layer stacks of different material.

Figure 4B:
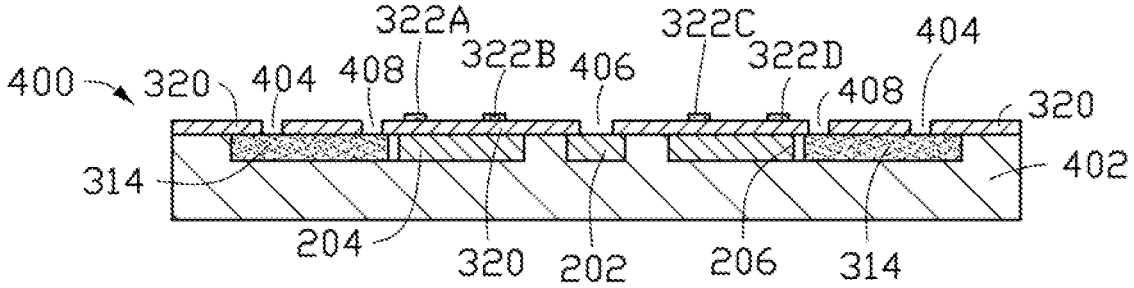

As shown in FIG. 4B, an electrically insulating layer 320 is then deposited over the electrodes 314, 202, 204, 206. Suitable materials for the electrically insulating layer 320 include silicon based materials including silicon-oxide, silicon-dioxide, silicon-nitride and silicon-oxynitride. Small landing posts 322A-322D are deposited on top of the insulating layer 320. As shown in FIG. 4B, the electrically insulating layer 320 is removed over the RF electrode 202 and over portions of the anchor electrode 314 to create openings 404, 406, 408.

Figure 4C:
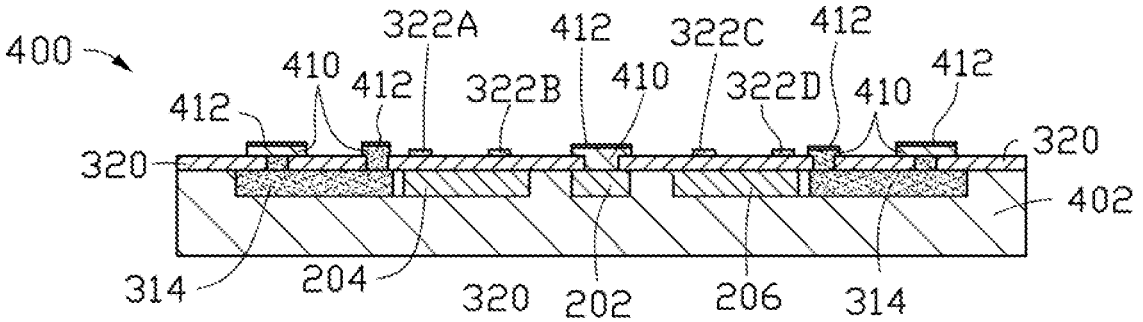

Electrically conductive material 410 may then be deposited over the electrically insulating layer 320 and in the openings 404, 406, 408 as shown in FIG. 4C. The electrically conductive material 410 provides the direct electrical connection to the RF electrode 202 and to the device anchor electrode 314. Suitable materials that may be used for the electrically conductive material 410 include titanium, titanium nitride, tungsten, aluminum, combinations thereof and multilayer stacks that include different material layers. Over the RF electrode, the electrically conductive material may correspond to post 316 and over the anchor electrode the electrically conductive material may correspond to post 318. On top of conductive material 410 a thin layer of conductive contact material 412 is deposited which will provide the contact to the MEMS bridge in the landed-down state. Suitable materials that may be used for the electrically conductive contact material 412 include W, Pt, Ir, Rh, Ru, $RuO_2$, ITO and Mo. The small landing posts 322A-322D may be formed with the electrically conductive materials 410, 412 or by insulating material in a separate step.

Figure 4D:
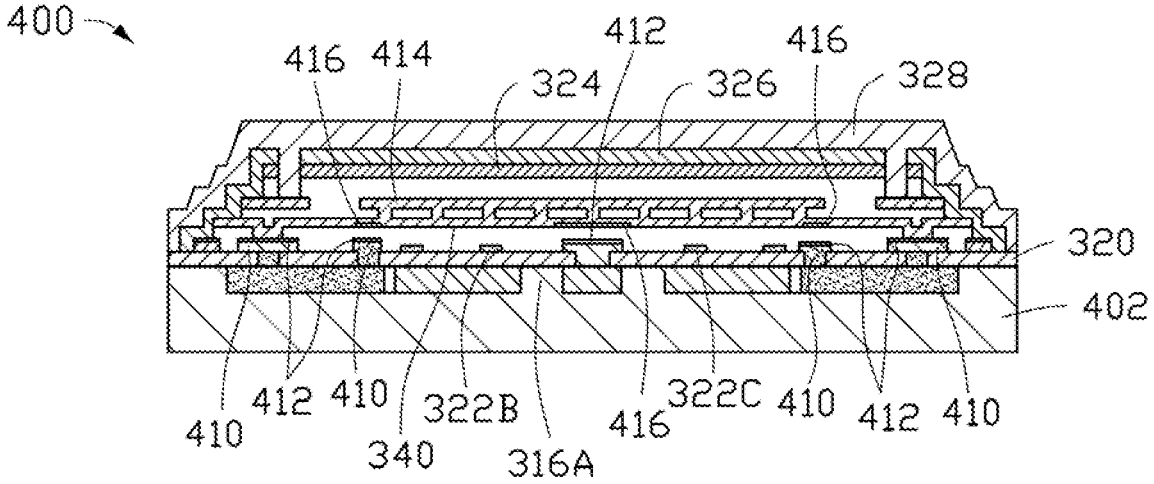
Figure 5A:
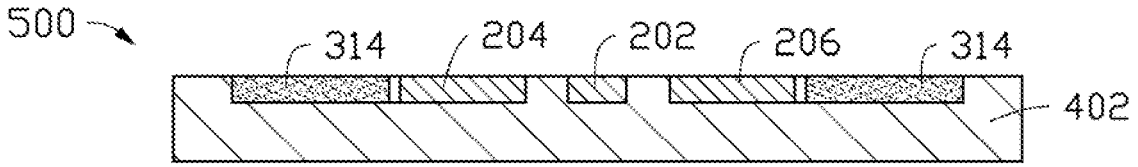
FIGS. 5A-5D are schematic illustrations of a MEMS ohmic switch at various stages of fabrication according to another embodiment.
Figure 5B:
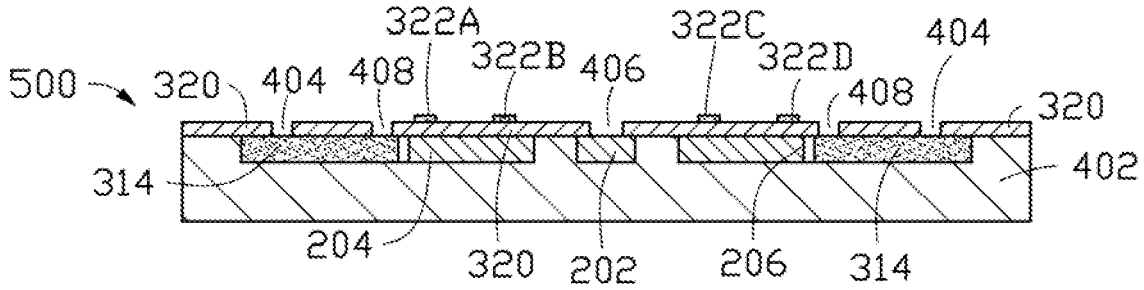
Figure 5C:
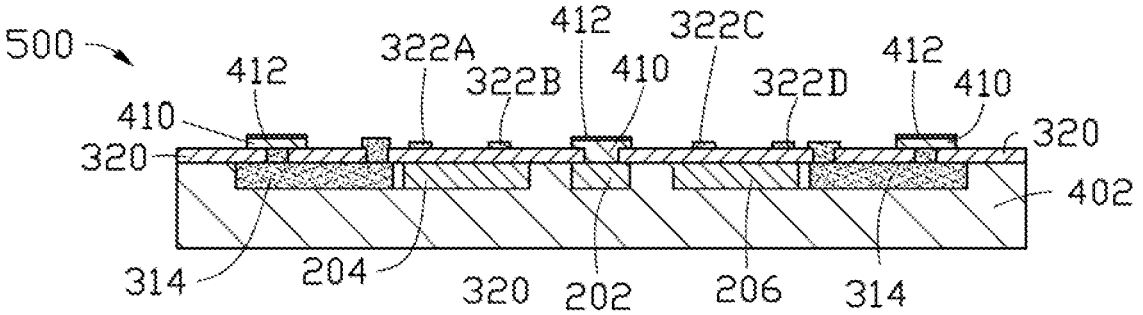
Figure 5D:
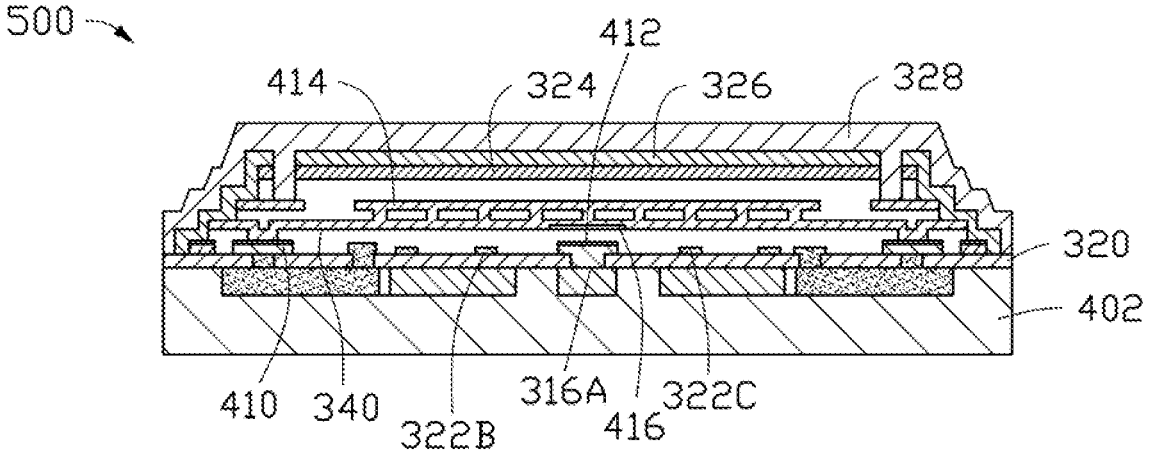

Once the electrically conductive materials 410, 412 have been patterned, the remainder of the processing may occur to form the MEMS ohmic switch 400 shown in FIG. 4D. As noted above, the switching element 414 may have insulating material coating the bottom surface thereof. In selected regions portions of this dielectric layer is removed and thus, an area 416 of exposed conductive material may be present that will land on the surface material 412. An additional electrically insulating layer 324 may be formed over the pull-off (i.e., pull-up) electrode 326, and a sealing layer 328 may seal the entire MEMS device such that the switching element 414 is disposed within a cavity. During fabrication, sacrificial material is used to define the boundary of the cavity.

FIGS. 5A-5D are schematic illustrations of a MEMS ohmic switch 500 at various stages of fabrication according to one embodiment. The fabrication steps for MEMS switch 500 are the same as for MEMS switch 400 except that openings 416 are not formed over the anchor-post regions. Rather, the insulating layer at the underside of the switching element 414 remains in place at the location of the post 318 so that when the switching element is in contact with the post 318, the posts 318 are not electrically coupled to the anchor electrode 314, but are only coupled thermally.

The conductive posts disclosed herein are beneficial to provide a thermal conductance that assists in cooling the switching element. Furthermore, the posts may also provide an electrical connection between the switching element and the anchor electrode that may additionally cool the switching element. The added electrical contact along the MEMS device removes current and heat from the MEMS structure close to the hottest points when the switching element is in contact with the posts.

While the foregoing is directed to embodiments of the present disclosure, other and further embodiments of the disclosure may be devised without departing from the basic scope thereof, and the scope thereof is determined by the claims that follow.

The invention claimed is:

1. A MEMS device, comprising:

a substrate having a plurality of electrodes formed therein, wherein the plurality of electrodes comprises at least an anchor electrode, a pull-in electrode and an RF electrode;

a first insulating layer disposed over the plurality of electrodes and the substrate;

a switching element disposed over the first insulating layer, wherein the switching element includes an anchor portion, a leg portion and a bridge portion and wherein the anchor portion is electrically coupled to the anchor electrode;

a first post coupled to the RF electrode, wherein the first post comprises an electrically conductive material and the first post is disposed directly on both the RF electrode and the first insulating layer; and a second post electrically coupled to the anchor electrode through a first opening formed in the first insulating layer, wherein the switching element is movable between a first position spaced from the first post and the second post, and a second position in contact with the first post and the second post.

2. The MEMS device of claim 1, wherein the second post comprises an electrically and thermally conductive material.

3. The MEMS device of claim 1, wherein the second post and the first post each have a top surface and wherein the top surfaces comprise the same material.

4. The MEMS device of claim 1, wherein the second post is positioned at a location such that the bridge portion is in contact with the second post when the switching element is in the second position.

5. The MEMS device of claim 1, wherein the first post is positioned at a location such that the bridge portion is in contact with the first post when the switching element is in the second position.

6. The MEMS device of claim 1, further comprising a pull-up electrode disposed over the switching element.

7. The MEMS device of claim 1, wherein the anchor portion is electrically coupled to the anchor electrode through a second opening formed in the first insulating layer.

8. A MEMS device, comprising:

a substrate having a plurality of electrodes formed therein, wherein the plurality of electrodes comprises at least an anchor electrode, a pull-in electrode and an RF electrode;

a first insulating layer disposed over the plurality of electrodes and the substrate;

a switching element disposed over the first insulating layer, wherein the switching element includes an anchor portion, a leg portion and a bridge portion and wherein the anchor portion is electrically coupled to the anchor electrode, and wherein the switching element comprises an electrically conductive material;

a first post coupled to the RF electrode, and the first post is disposed directly on both the RF electrode and the first insulating layer;

a second post disposed over the anchor electrode and electrically coupled to the anchor electrode through a first opening formed in the first insulating layer, wherein the switching element is movable between a first position spaced from the first post and the second post, and a second position in contact with the first post and the second post; and a second insulating layer disposed on a bottom surface of the switching element, wherein the first post contacts the electrically conductive material of the switching element through the second insulating layer when the switching element is in the second position.

9. The MEMS device of claim 8, wherein the second post comprises an electrically and thermally conductive material.

10. The MEMS device of claim 8, wherein the second post and the first post each have a top surface and wherein the top surfaces comprise the same material.

11. The MEMS device of claim 8, wherein the second post is positioned at a location such that the bridge portion is in contact with the second post when the switching element is in the second position.

12. The MEMS device of claim 8, wherein the first post is positioned at a location such that the bridge portion is in contact with the first post when the switching element is in the second position.

13. The MEMS device of claim 8, further comprising a pull-up electrode disposed over the switching element.

14. The MEMS device of claim 8, wherein the anchor portion is electrically coupled to the anchor electrode through a second opening formed in the first insulating layer.

15. A method of forming a MEMS device, comprising:

depositing an insulating layer over a substrate, the substrate having a plurality of electrodes formed therein, wherein the plurality of electrodes includes at least an anchor electrode, a pull-in electrode and an RF electrode, wherein the insulating layer is disposed over the plurality of electrodes and the substrate;

removing at least a portion of the insulating layer to expose at least a portion of the anchor electrode and at least a portion of the RF electrode;

forming a first post over and in contact with the RF electrode, wherein the first post comprises an electrically conductive material, and the first post is disposed directly on both the RF electrode and the insulating layer;

forming a second post over and in contact with the anchor electrode through an opening formed in the insulating layer; and forming a switching element over the substrate, first post and second post, wherein the switching element is disposed over the insulating layer, wherein the switching element includes an anchor portion that is electrically coupled to the anchor electrode, a bridge portion, and a leg portion and the RF electrode, wherein the switching element is movable between a first position spaced from the first post and the second post and a second position in contact with the first post and the second post.

16. The method of claim 15, wherein the second post comprises an electrically and thermally conductive material.

17. The method of claim 16, wherein the switching element has a bottom surface having a first portion that is both electrically and thermally conductive and a second portion that is electrically insulating.

18. The method of claim 15, wherein the second post and the first post each have a top surface and wherein the top surfaces comprise the same material.

19. The method of claim 15, wherein the second post is positioned at a location such that the bridge portion is in contact with the second post when the switching element is in the second position.

20. The method of claim 15, wherein the first post is positioned at a location such that the bridge portion is in contact with the first post when the switching element is in the second position.

21. The method of claim 15, further comprising forming a pull-up electrode disposed over the switching element.

22. A method of forming a MEMS device, comprising:

depositing an insulating layer over a substrate, the substrate having a plurality of electrodes formed therein, wherein the plurality of electrodes includes at least an anchor electrode, a pull-in electrode and an RF electrode;

removing at least a portion of the insulating layer to expose at least a portion of the anchor electrode and at least a portion of the RF electrode;

forming a first post over and in contact with the RF electrode, wherein the first post comprises an electrically conductive material and the first post is disposed directly on both the RF electrode and the insulating layer;

forming a second post over the anchor electrode, wherein the second post is electrically coupled to the anchor electrode through an opening formed in the insulating layer; and forming a switching element over the substrate, first post and second post, wherein the switching element includes an anchor portion that is electrically coupled to the anchor electrode, a leg portion and the RF electrode, wherein the switching element is movable from a first position spaced from the first post and the second post and a second position in contact with the first post and the second post, wherein the switching element has a bottom surface that has an insulating portion and a conductive portion, and wherein the insulating portion contacts the second post in the second position and the conductive portion contacts the first post in the second position.

23. The method of claim 22, wherein the second post comprises an electrically and thermally conductive material.

24. The method of claim 23, wherein the switching element has the bottom surface having a first portion that is both electrically and thermally conductive and a second portion that is electrically insulating.

25. The method of claim 22, wherein the second post and the first post each have a top surface and wherein the top surfaces comprise the same material.

26. The method of claim 22, wherein the second post is positioned at a location such that a bridge portion of the switching element is in contact with the second post when the switching element is in the second position.

27. The method of claim 22, wherein the first post is positioned at a location such that a bridge portion of the switching element is in contact with the first post when the switching element is in the second position.

28. The method of claim 22, further comprising forming a pull-up electrode disposed over the switching element.

* * * * *